US005125177A

United States Patent [19]

Colting

[11] Patent Number: 5,125,177

[45] Date of Patent: Jun. 30, 1992

[54] MULTI-PIECE INFLATABLE DEVICE

[76] Inventor: Hakan Colting, 994 Stonehaven Ave., Newmarket, Ontario, Canada, L3X 1P2

[21] Appl. No.: 560,705

[22] Filed: Jul. 31, 1990

[51] Int. Cl.[5] ..... G09F 15/00

[52] U.S. Cl. ..... 40/610; 446/226

[58] Field of Search ..... 40/610, 212, 214, 412, 40/620; 446/72, 74, 220, 223, 226, 178, 199, 222, 75; 272/8 N, 27 N

[56] References Cited

U.S. PATENT DOCUMENTS 3,159,935 12/1964 Rubens ..... 446/199 X
3,316,669 5/1967 Nachbar ..... 40/620
4,586,456 5/1986 Forward ..... 446/222 X
4,776,121 10/1988 Vicino ..... 40/610
4,903,958 2/1990 Di Carlo ..... 272/27 N
4,920,674 5/1990 Shaeffer ..... 40/214 X

*Primary Examiner*—Laurie K. Cranmer
*Assistant Examiner*—J. Bonifanti
*Attorney, Agent, or Firm*—Bereskin & Parr

[57] ABSTRACT

A multi-piece inflatable piece is provided. The inflatable has a base portion which contains an inflating blower. A top portion is releasably attached to the base portion permitting a single base portion to be used with variously shaped top portions. In one embodiment the base portion is a pail into which the top portion may be collapsed for storage and shipping purposes.

6 Claims, 5 Drawing Sheets

MULTI-PIECE INFLATABLE DEVICE

FIELD OF THE INVENTION

This invention relates to inflatable devices of the type commonly used for promotional and advertising purposes.

BACKGROUND OF THE INVENTION

Large inflatable devices shaped and coloured to represent fictitions characters or corporate logos are frequently used for promotional and advertising purposes. Such inflatable devices are frequently twenty to thirty feet tall and are secured either to the ground or to the top of a building structure such as a shopping mall.

These inflatable devices typically comprise a pliable shell contoured to a desired shape when inflated and a blower or other means for providing a pressurized fluid (usually air) into the interior of the inflatable. The shape of these inflatables is generally not changeable so that a different inflatable is required for each application. This incurs the cost of providing a complete new structure for each different shape and also requires separate storage space for each shape. Furthermore typically only one message can be communicated by each inflatable.

SUMMARY OF THE INVENTION

An inflatable device is provided comprising a base portion;

a top portion;

releasable securing and sealing means for securing said base portion to said top portion and for forming a fluid seal between said base and top portions;

fluid communication means for providing fluid communication between said base portion and said top portion;

fluid pressurizing means communicating with said base portion for delivering pressurized fluid into the interior of said inflatable at above ambient pressure.

DESCRIPTION OF THE DRAWINGS

Preferred embodiments of the present invention are described below with reference to the attached drawings in which.

DESCRIPTION OF PREFERRED EMBODIMENTS

Figure 1:
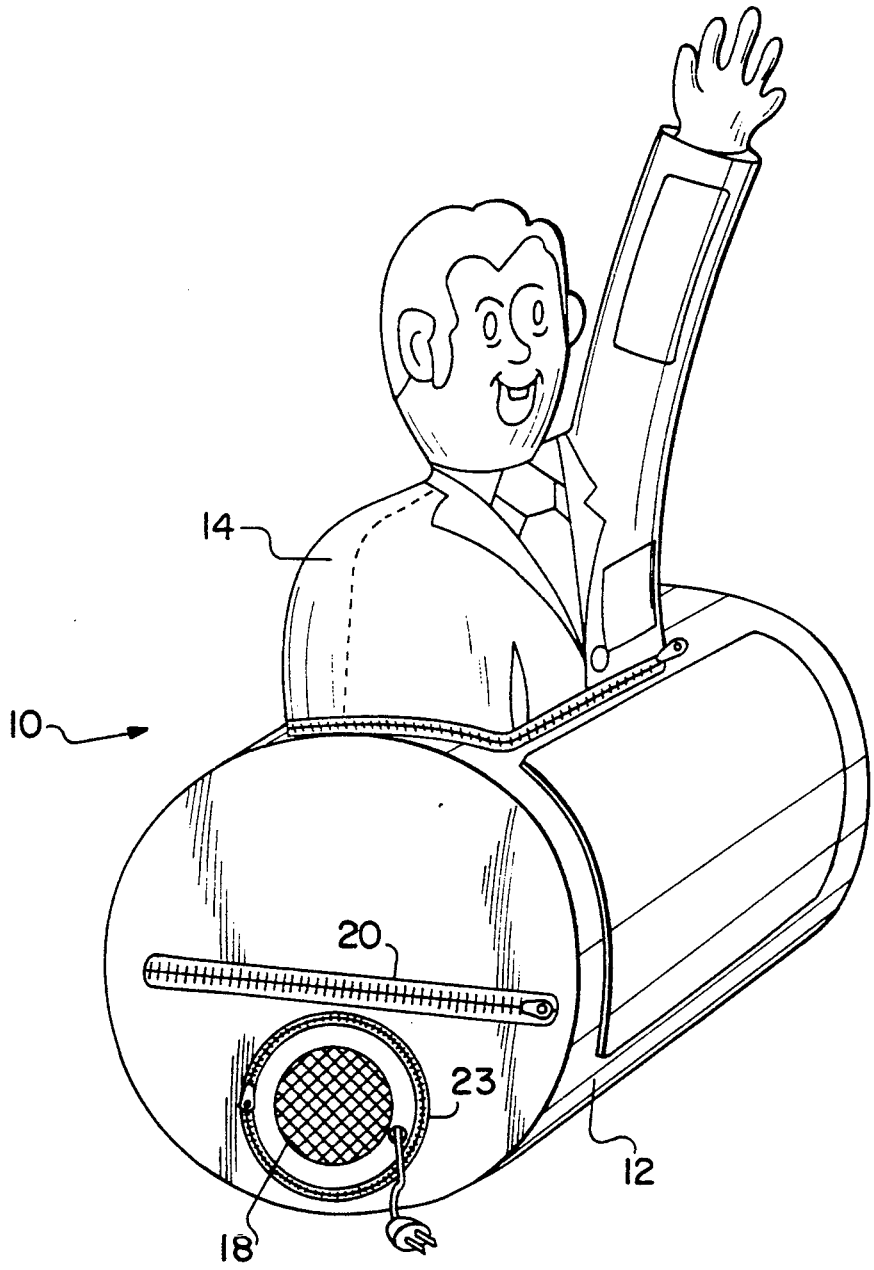
FIG. 1 is a perspective view of an inflatable according to the present invention.
Figure 2:
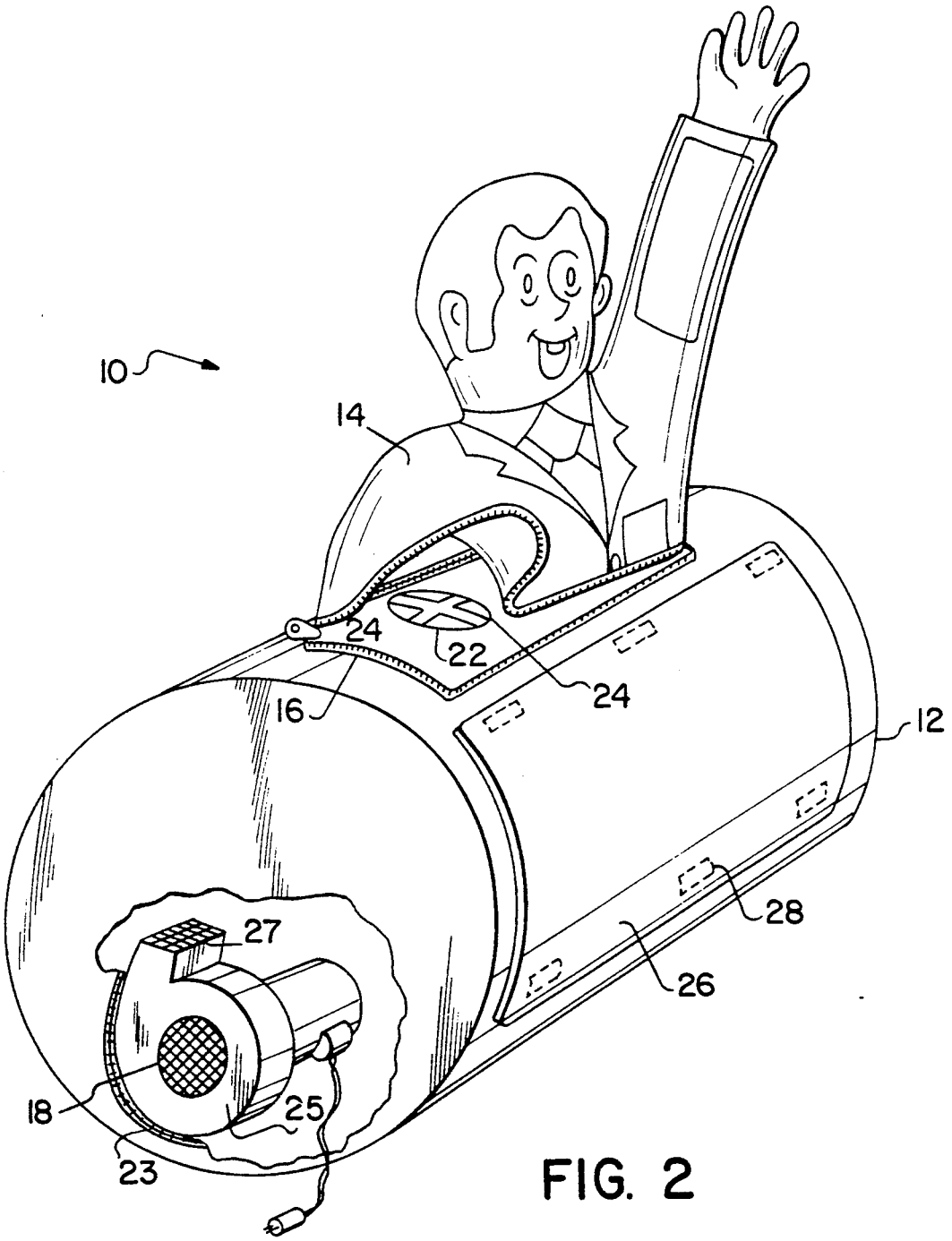
FIG. 2 is a perspective view of an inflatable according to the present invention with the top portion partially removed from the bottom portion.

Referring to FIGS. 1 and 2 an inflatable device, or simply "inflatable" is generally indicated by Reference 10. The inflatable has a generally cylindrical base portion 12 surmounted by a top portion 14 shaped to resemble the upper torso of a fictitious character.

The top portion 14 and base portion 12 are releasably secured at their juncture by a zipper or slide fastener 16. Although a zipper is illustrated it will be appreciated that alternate securing means such as a hook and loop type fastener may be used. As will be described in more detail below, in use both the top portion 14 and base portion 12 are pressurized, with the top portion 14 receiving air from the base portion 12. Accordingly the releasable securing means selected must provide enough of a fluid seal between the top portion and the base portion to prevent the collapse of the inflatable 10 during use. It is not necessary that a totally fluid tight seal be effected and the term "fluid seal" is to be interpreted to include a less than perfect seal.

Referring to FIG. 2, the base portion contains an electrically powered blower 25 having an air inlet 18. The blower 25 receives air from the inlet 18 and discharges it through outlet 27 into the interior of the base portion 12 at a pressure above the ambient pressure surrounding the inflatable 10. An access opening 20 is provided in the base portion 12 adjacent the blower opening 18 for accessing the inside of the base portion 12. The access opening 20 is closeable by a zipper or like means. Suitable results have been obtained using a * Dayton Model 8C338 blower.

Rather than permanently securing the inlet 18 of the blower to the end of the base portion 12, a zipper or like fastening means may be provided between the blower inlet and the end of the base portion 12. In FIGS. 1 and 2 such releasable securement is provided by a zipper 23 surrounding the blower opening 18.

Referring to FIG. 2, fluid communication between the base portion 12 and the top portion 14 of the inflatable 10 is provided by apertures 22 in the top of the base portion 10. The apertures 22 are reinforced by straps 24 extending thereacross which help to prevent tearing of the apertures 22 and deformation of the top of the base portion 12.

The base portion 12 further has a display panel 26 releasably attached to one side by releasable attaching means such as hook and loop fasteners 28 shown in ghost outline.

Figure 3:
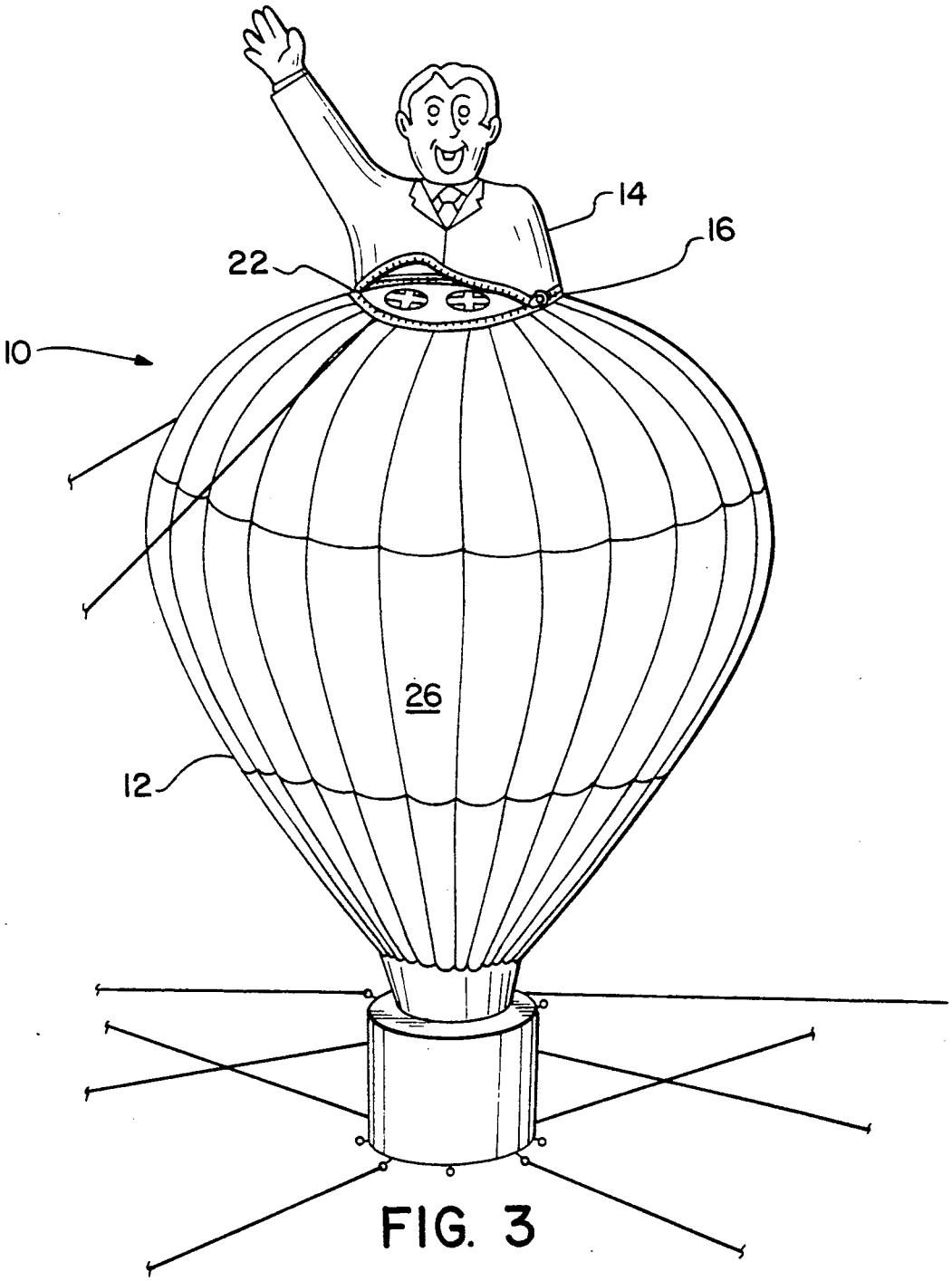
FIG. 3 is a perspective view of a further embodiment of an inflatable according to the present invention.
Figure 4:
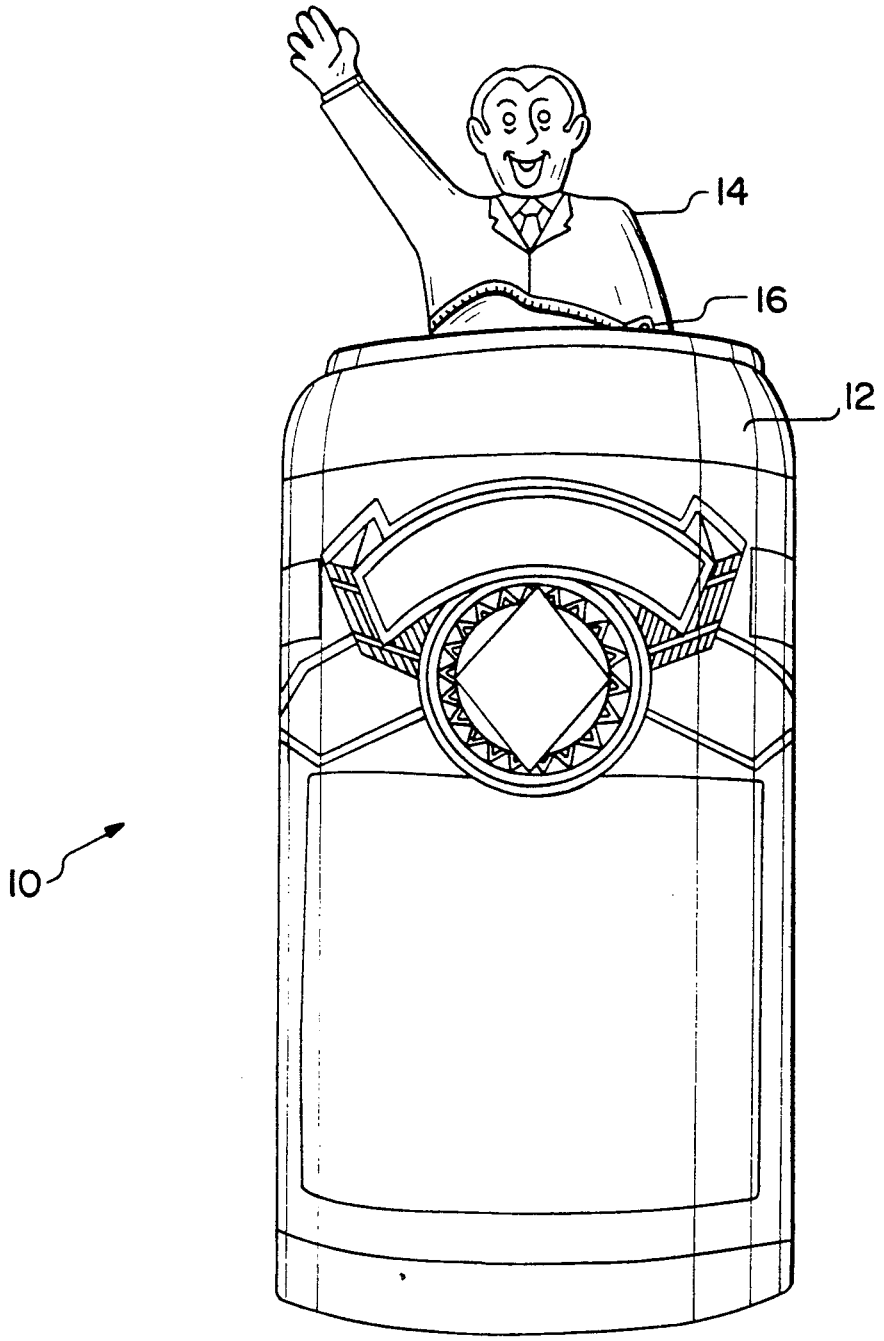
FIG. 4 is a perspective view of a still further embodiment of an inflatable according to the present invention.
Figure 5:
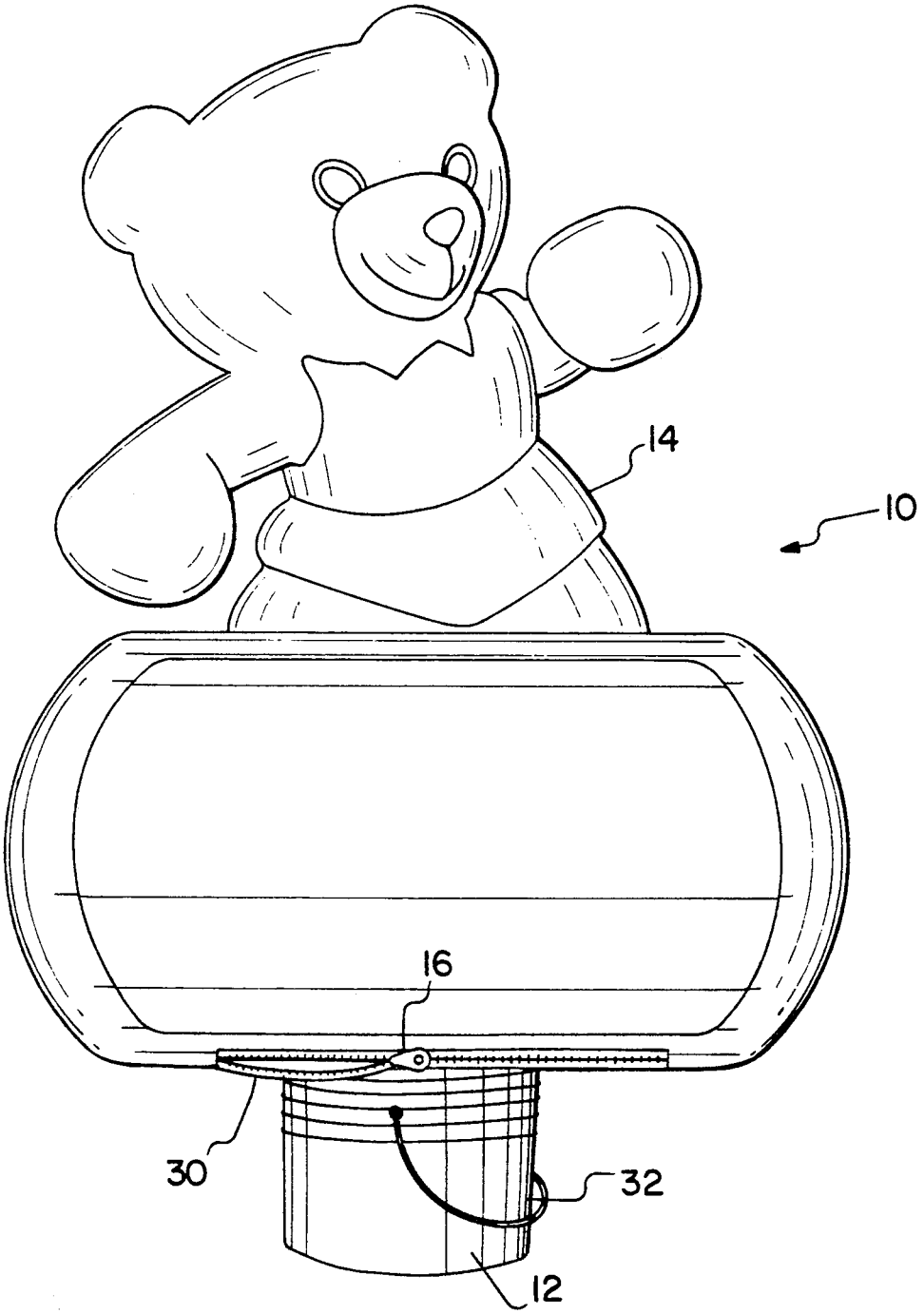
FIG. 5 is a perspective view of yet another embodiment of an inflatable according to the present invention.

The shape of the base portion 12 and top portion 14 of the inflatable 10 is virtually unlimited as these parts can be virtually any shape that will contain air. Examples of alternate shapes are shown in FIGS. 3, 4 and 5. In the inflatable 10 of FIG. 3, the base portion 12 has a balloon shape while the base portion 12 of the inflatable 10 in FIG. 4 is shaped to resemble a beverage can.

A novel feature of the inflatables 10 in FIGS. 3 and 4 is the combination of messages which may be delivered. For example, a beverage seller may select an inflatable 10 as shown in FIG. 4 having a base portion 12 in the shape of a beverage can printed to resemble their product. When such a beverage corporation is sponsoring a sporting event they may select a top portion 14 having a shape which is relevant to the theme of the sporting event, for example, the torso portion of a baseball player with a baseball bat, a racing car, a football etc.

There are several benefits which arise from such combination of messages between the base portion 12 and the top portion 14. A first advantage is that a standard base portion 12 may be used by an advertiser for all of the events at which they wish to draw attention. The base portion is typically the more expensive part of the inflatable 10 as it usually contains the blower and furthermore the base portion as shown in FIGS. 3 and 4 may be the larger part of the inflatable. Accordingly the advantages to having interchangeable base portions include saving the cost of having separate inflatables for each theme even though the inflatables have similarly shaped base portions 10 and furthermore saving the storage space which would otherwise be required to store separate one piece inflatables having similarly shaped lower portions.

The storage and portability of the inflatables 10 may further be improved using a configuration such as illustrated in FIG. 5. In the inflatable 10 of FIG. 5 the base portion 12 is a pail around the rim of which is bonded a generally concentric flange 30 of generally the same flexible material as the top portion 14 of the inflatable. The zipper 16 in the inflatable 10 of FIG. 5 extends between the flange 30 and the top portion 14 of the inflatable. The blower motor is contained within the pail which forms the base portion 12.

The base portion 12 of the inflatable of FIG. 5 acts as a storage container within which the top portion 14 may be collapsed when the inflatable is not in use. The pail may further be provided with a lid for closing the pail and a handle 32 for carrying the pail. Such a configuration is desirable in that it is very compact and the pail acts to protect the flexible portion of the inflatable during shipping and storage.

It is to be appreciated that the above description is to be interpreted in an illustrative rather than a restrictive sense and that variations may be apparent to those skilled in the art of inflatable devices in adapting the present invention to particular applications. Furthermore, although a single top portion has been described it is to be understood that a plurality of such top portions may similarly be attached to a base portion. Accordingly it is intended that the expression "top portion" be interpreted broadly enough to include two or more such portions.

I claim:

1. An inflatable promotional device, comprising:

an inflatable base portion;

an inflatable upper portion which rests upon said base portion when said upper portion is inflated;

releasable sealing and securing means for substantially sealing and securing said upper portion to said base portion such that said upper portion may be readily interchanged with other upper portions;

fluid communication means for providing fluid communication between said base portion and said upper portion; and fluid pressurizing means communicating with said base portion for delivering fluid to said base portion at above ambient pressure.

2. The inflatable device of claim 1, wherein said releasable sealing and securing means comprises slide fastener means.

3. An inflatable promotional device, comprising:

a base portion;

an inflatable upper portion which rests upon said base portion when said upper portion is inflated;

slide fastener means for substantially sealing and securing said upper portion to said base portion such that said upper portion may be readily interchanged with other upper portions;

fluid communication means between said base portion and said upper portion; and fluid pressurizing means substantially within said base portion for delivering fluid to said base portion at above ambient pressure.

4. The inflatable device of claim 3 wherein said base portion is substantially rigid and may contain said upper portion for storage when said inflatable device is deflated.

5. An inflatable promotional device, comprising:

a base portion;

an inflatable upper portion which rests upon said base portion when said upper portion is inflated;

slide fastener means for substantially sealing and securing said upper portion to said base portion such that said upper portion may be readily interchanged with other upper portions;

fluid communication means between said base portion and said upper portion; and an air blower removably located within said base portion having an air entry opening connected to said base portion by further releasable securing and sealing means.

6. The inflatable device of claim 5 wherein said base portion is substantially rigid and may contain said upper portion for storage when said inflatable device is deflated.

* * * * *